US005545294A

United States Patent [19]

Lindén et al.

[11] Patent Number: 5,545,294

[45] Date of Patent: Aug. 13, 1996

[54] MULTILAYER HEADBOX

[75] Inventors: Anders T. Lindén; Bo L. H. Örtemo, both of Karlstad, Sweden

[73] Assignee: Valmet-Karlstad AB, Karlstad, Sweden

[21] Appl. No.: 290,696

[22] Filed: Aug. 15, 1994

[30] Foreign Application Priority Data

Sep. 13, 1993 [SE] Sweden ..... 93 02980

[51] Int. Cl.[6] ..... D21F 1/02

[52] U.S. Cl. ..... 162/343; 162/336; 162/344

[58] Field of Search ..... 162/123, 343, 162/336, 344

[56] References Cited

U.S. PATENT DOCUMENTS

| | | | |
|---|---|---|---|
| 4,181,568 | 1/1980 | Pfaler | 162/343 |
| 4,436,587 | 3/1984 | Andersson | 162/123 |
| 4,566,945 | 1/1986 | Ewald et al. | 162/343 |
| 4,617,091 | 10/1986 | Rodel et al. | 162/343 |
| 4,812,209 | 3/1989 | Kinzler et al. | 162/343 |
| 4,891,100 | 1/1990 | Hildebrand | 162/343 |
| 5,431,785 | 7/1995 | Bubik et al. | 162/343 |

FOREIGN PATENT DOCUMENTS

| | | |
|---|---|---|
| 1134658 | 11/1982 | Canada . |
| 1139142 | 1/1983 | Canada . |
| 2119824 | 11/1983 | United Kingdom . |

*Primary Examiner*—Karen M. Hastings
*Attorney, Agent, or Firm*—Bell, Seltzer, Park & Gibson, P.A.

[57] ABSTRACT

A three-layer headbox has two rigid separator vanes (11; 12) mounted in the headbox slice chamber (10) to form two outer stock flow channels (39; 41) and an intermediary one (40). The upstream end of each vane (11; 12) is securely fixed in cantilever fashion and its downstream end (15; 16) is unattached and free and provided with a vane extension (17; 18). Also the downstream end (20; 22) of the extension (17; 18) is unattached and free and is located just downstream of the slice opening (14). The vane extension (17; 18) is thinner than the vane (11; 12), so that a step (23, 24) is formed on each side of the vane (11; 12) and extension (17; 18) assembly. To improve the layer formation, each vane (11; 12) and each vane extension (17; 18) has a portion located in a converging downstream portion (13) of the slice chamber (10), and the vane portions and the extension portions are of substantially equal length. Preferably, the vane extension (17; 18) is tapered, as rigid as possible, and consists of glass fiber reinforced epoxy resin. Further, the step (23) located in the outer channel (39; 41) is about twice as high as the step (24) located in the intermediary channel (40).

9 Claims, 2 Drawing Sheets

MULTILAYER HEADBOX

FIELD AND BACKGROUND OF THE INVENTION

The present invention relates to a multilayer headbox.

More particularly, the invention relates to a multilayer headbox of the type having a slice chamber and in the slice chamber a rigid separator vane for keeping stock flow streams on each side of the vane separated from each other, said slice chamber having a downstream portion converging in the direction of the stock flow and ending in a slice opening, said vane having an upstream end and a square downstream end, said vane being securely fixed in cantilever fashion at said upstream end and having its downstream end unattached and free, said vane being sufficiently rigid to be capable of supporting unequal pressures and velocities in the stock flow streams, said headbox further having a vane extension having an upstream end and a downstream end, the upstream end of the vane extension being thinner than and exchangeably anchored to the square downstream end of the separator vane to form an extended vane assembly having a step on each side of the assembly, the downstream end of the vane extension being unattached and free and located downstream of the slice opening.

Such a multilayer headbox is disclosed in Canadian Patent No. 1,139,142 (AB Karlstads Mekaniska Werkstad). In this headbox, widely known as the KMW Air Wedge Headbox, the rigid vane (or vanes) may consist of a glass fiber reinforced epoxy resin and have a constant thickness of 12 millimeters (about ½ in), for example. The vane has internal channels for supplying air to its downstream edge, which is located slightly downstream of the slice opening. Thereby, there is formed at the downstream edge a wedge of air that keeps the stock flow streams on each side of the vane separated part of a distance to the forming zone of the papermaking machine, while the stock flow streams travel through surrounding air. A vane extension formed by a comparatively thin flexible foil may be exchangeably anchored to the square downstream end of the vane to keep the stock flow streams separated a further part of the distance downstream of the edge of the air wedge. Such a foil will eliminate any velocity components perpendicular to the stock flow streams and thereby contribute to an improvement of the layer purity and the layer formation.

FIGS. 9*b* and 9*d* and pages 15 to 17 of Canadian Patent No. 1,134,658 (AB Karlstads Mekaniska Werkstad) disclose a design for exchangeably anchoring a foil to a square downstream end of a separator vane. The foil has a row of equidistantly spaced dowels at but spaced from its upstream end. The dowels are of a larger length than diameter, and all of the dowels extend through the foil and project equal distances in opposite directions from the foil. A longitudinally extending groove for receiving the upstream end of the foil including the dowels is provided in an end face of the square downstream end of the vane. Both sidewalls of the groove have a longitudinally extending recess for accommodating the projecting parts of the dowels. The groove is placed symmetrically in the end face, so that the steps formed on both sides of the vane-foil assembly are equal.

As disclosed in U.S. Pat. No. 4,436,587 (Andersson), multilayer paper of superior layer purity and layer formation can be produced by discharging a plurality of superimposed jets of papermaking stock from an air wedge headbox into the throat of a roll type twin wire former, and maintaining the velocity of the jet closest to a plain forming roll in the roll former slightly higher than the velocity of an adjacent discharged jet. The separator vane or vanes provided in the slice chamber are sufficiently rigid to be capable of supporting unequal pressures and velocities in the stock flow streams. By controlling the pressure in one stock flow stream relative to the pressure in an adjacent stock flow stream, a pressure difference across the vane may be created. This pressure difference causes a deflection of the vane, which results in a movement of the downstream end of the vane, so that different jet velocities are produced while the flow rates remain constant.

The air wedge multilayer headbox has been on the market for over a decade. Its most pronounced advantages have been its ability to produce an excellent layer purity and the durability of its separator vanes. The experienced life is several years. However, one or two 12 millimeters (about ½ in) thick vanes extending out of the slice opening means that the total slice opening, that is slice lip to slice lip, has to be large and, consequently, a long free jet from the slice opening to the forming zone is required. Even though the two or three jets, one for each layer in the paper to be produced, are kept separated from one another by the air wedges and the possible foils for a considerable portion or even all of the distance to the forming zone, the cross sectional shape of the jet deteriorates with the length travelled by the free jet. Thus, a layer formation of the same excellent class as the layer purity can not be achieved. In addition, the flexible foils risk being damaged on an exchange of forming fabrics.

U.S. Pat. No. 4,812,209 (Kinzler et al.) discloses another type of multilayer headbox. As in the air wedge headbox, a separator vane extends through the slice chamber from one side wall to the other and through the slice opening to form an upper flow channel and a bottom flow channel and keep stock flow streams separated from each other. However, the separator vane is of a wedge-shaped cross section and has an upstream body portion, which may be of steel and be rigidly connected to an upstream tube bank by means of welding, and a downstream tip portion, which to facilitate exchange may be made of a reinforced synthetic material, as rigid as possible. There is no step at the connection between the body portion and the tip portion of the vane, so the taper of the vane thickness is continuous to the very edge of the tip portion. Instead, the connection is stated to be rigid and at the same time so tightly sealed along the joint that a clinging of fibers is ruled out. Further, each of the headbox side walls is divided into a lower wall section and an upper wall section, which laterally confine the bottom flow channel and the upper flow channel, respectively. The width of the tapered separator vane in the cross machine direction is larger than the distance between the headbox side walls to permit the lateral edges of the vane to be clamped between the upper and the lower wall section on both sides of the headbox.

As a result of the clamping of the lateral edges of the vane, the headbox is unsuitable for operating with unequal pressures and velocities in the stock flow streams, at least in machines that are wider than the very narrowest production machines, because when a laterally clamped vane is exposed to unequal pressures in the two adjacent stock flow channels, the clamping prevents the vane from deflecting ideally and assume a deflection profile, where the vane is straight from headbox side wall to headbox side wall but curved from its upstream edge to its downstream edge. When the vane, which is rigidly connected at its upstream end and clamped along its lateral sides, is exposed to different pressures in the two adjacent stock flow channels, it will assume a slight partially dome-shaped deflection profile. The profile from side wall to side wall will be straight at the upstream edge of the vane but become more curved with increasing distance from the upstream edge, and at both of the side walls the profile from the upstream edge to the downstream edge will be straight but become more curved with increasing distance from the side walls. Consequently, since the downstream edge of the vane will not remain straight, the layer caliper and/or the layer basis weight profile will vary over the width of the produced web.

SUMMARY OF THE INVENTION

The object of the present invention is to provide a multilayer headbox, which when combined with a roll type twin wire former will produce a multilayer paper web of improved layer formation while maintaining the excellent layer purity and also the separator vane durability.

In accordance with the present invention this object is achieved by providing the initially disclosed multilayer headbox with a vane and a vane extension of a design such that both of the vane and the vane extension have a portion located in the converging portion of the slice chamber, and those portions of the vane extension and of the vane that are located in the converging portion of the slice chamber are of substantially equal length in the stock flow direction.

At the slice opening the thickness of the vane extension merely is a fraction of that of the vane, and the gap width of the slice opening will be considerably smaller in a multilayer headbox of the present invention than in an air wedge multilayer headbox, where the vane or vanes extend out of the slice opening. The reduced gap width requires less space, and if the distances from the slice lips to the forming fabrics are maintained, the slice lips can project farther into the converging throat defined by the fabrics just upstream of the forming zone. In a typical installation the free jet length from the slice lips to the forming zone can be reduced by more than half the length, e.g. to about 0.06 meters (about 2.4 in). This considerable reduction of the free length of the jet considerably reduces the deterioration in cross sectional shape of the jet. In addition, by those portions of the vane extension and of the vane that are located in the converging portion of the slice chamber being of substantially equal length in the stock flow direction, the step at the connection between the vane and the vane extension will be located at an optimal location e.g., midway between an upstream start of the converging portion of the slice chamber and the slice opening at the downstream end of the converging portion. The step creates an advantageous small scale turbulence in the stock flow streams to prevent detrimental flocculation of the papermaking fibers, and with the considerably reduced deterioration in the cross sectional shape of the jet there are created conditions for the production of a multilayer paper web having an excellent layer formation.

The vane extension may taper from a thickness on the order of 4 mm (about 0.16 in) at its upstream end to a thickness on the order of 1 mm (about 0.04 in) at its downstream end and consist of a material having a modulus of elasticity of at least $20 \cdot 10^9$ newtons per square meter (about $2.9 \cdot 10^6$ psi), suitably a fiber reinforced synthetic resin, preferably a glass fiber reinforced epoxy resin. To achieve the best possible result, the vane extension should be as rigid as possible.

The vane suitably has a constant thickness on the order of 0.01 meter, e.g. 12 millimeters (about ½ in). Such a thickness is sufficient for achieving the desired rigidity of the vane and also provides a suitable height of the step at the connection between the vane and the vane extension.

In view of other parameters in the design of the headbox, the vane extension preferably has a length on the order of 0.3 meters (about 12 in) in the direction of the stock flow.

It is also preferred that the vane extension has its free end located about 0.01 meter (about 0.4 in) downstream of the slice opening. Thereby, the projecting portion of the vane extension is short enough not to obstruct an exchange of forming fabrics, nor does it risk being damaged at the exchange.

To connect the vane extension to the vane it is preferred that the vane extension has a row of short equidistantly spaced dowels at, but spaced from, the upstream end of the vane extension. The short dowels are of a length that is smaller than a diameter of the dowel. All of the dowels are mounted with an end face flush with one face of the vane extension, and with a portion projecting from an opposite face of the vane extension. A longitudinally extending groove for receiving the upstream end of the vane extension including the dowels is provided in an end face of the square downstream end of the vane. This groove has a gap width on the order of 0.2 millimeters (about 0.008 in) larger than the thickness of the vane extension at the dowels. The groove also has a sidewall with a longitudinally extending recess for accommodating the projecting portions of the dowels.

In a three-layer headbox, where there are two vanes in the slice chamber to form two outer stock flow channels and an intermediary one, it is preferred that each of the grooves is located closer to the intermediary stock flow channel than to an adjacent one of the outer stock flow channels, so as to make the step located in said adjacent outer stock flow channel twice as high as the step located in the intermediary stock flow channel. Thereby, the increase in channel area at the step will be of the same magnitude in all of the three stock flow channels.

The present invention will below be described more in detail with reference to the appended drawings, which illustrate a preferred embodiment of the invention.

DETAILED DESCRIPTION OF THE MOST PREFERRED EMBODIMENT

Figure 1:
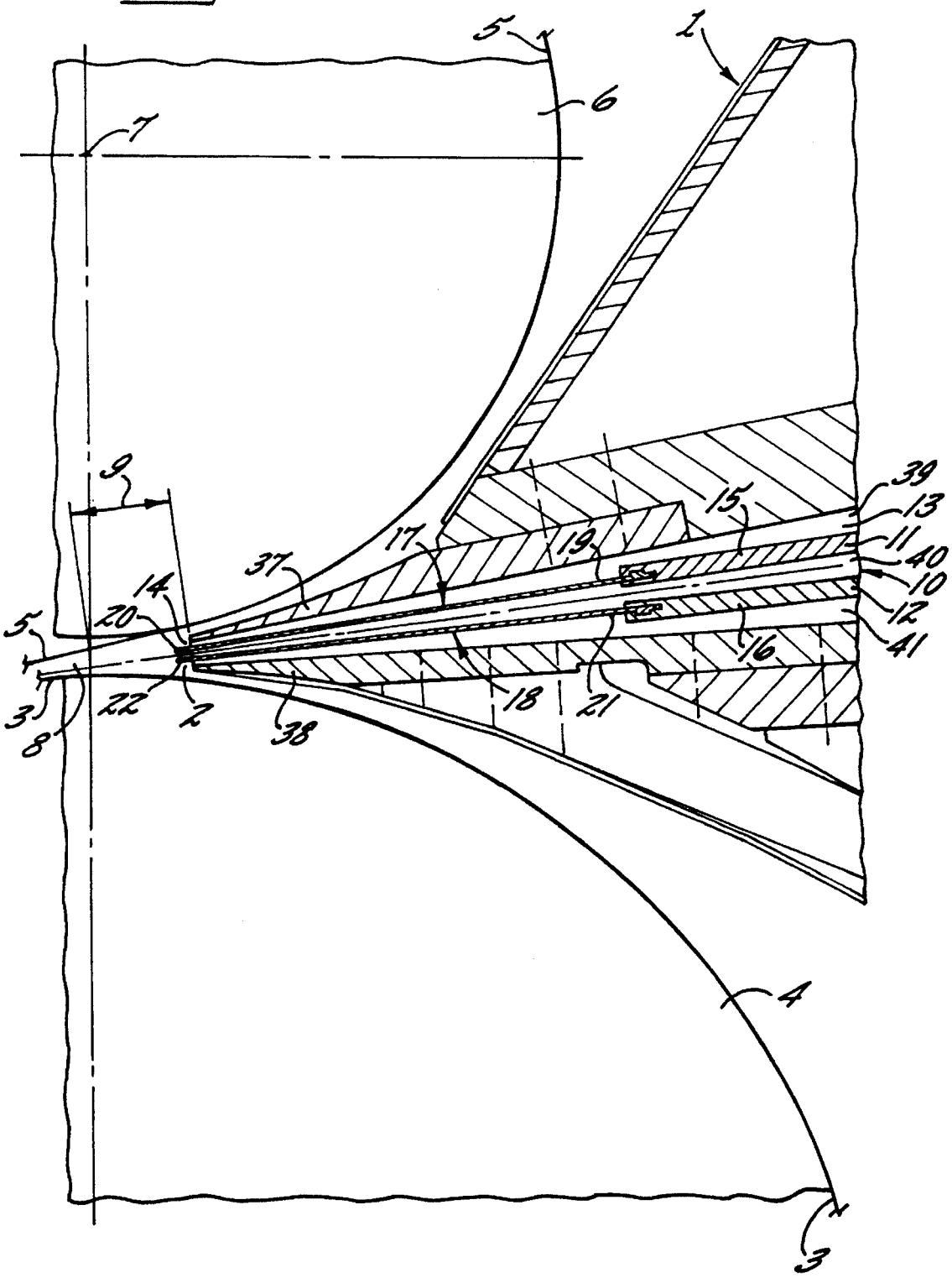
FIG. 1 is a machine direction cross sectional view of the downstream portion of a slice chamber of a preferred embodiment of a multilayer headbox having separator vanes and vane extensions and mounted to discharge a multilayer jet into a throat leading to the forming zone of a roll type twin wire former.

The multilayer headbox 1 shown in FIG. 1 is a three-layer headbox of thin channel type and is mounted for discharging a three-layer jet of papermaking stock into a throat 2 leading to a forming zone of a roll type twin wire former. In a thin channel headbox, the stock flow streams on leaving a tube bank distributor, not shown, and entering a slice chamber 10 are deflected an angle on the order of 80°, not shown. The twin wire former has a looped inner forming fabric 3, a rotatable forming roll 4 located within the loop of the inner forming fabric 3, a looped outer forming fabric 5, and a rotatable breast roll 6 located within the loop of the outer forming fabric 5. In the illustrated embodiment the forming zone starts where the discharged three-layer jet crosses a straight line connecting the rotational axis 7 of the breast roll 6 with that of the forming roll 4. From there, the forming zone curves along a section of the periphery of the forming roll 4. Only the very first portion 8 of the forming zone is shown. In the illustrated embodiment the twin wire former is a crescent former, in which the inner forming fabric is a felt 3, and in which the headbox 1 is mounted in an inverted position, i.e. the tube bank distributor is located on top of an upstream portion of the slice chamber 10.

Figure 5:
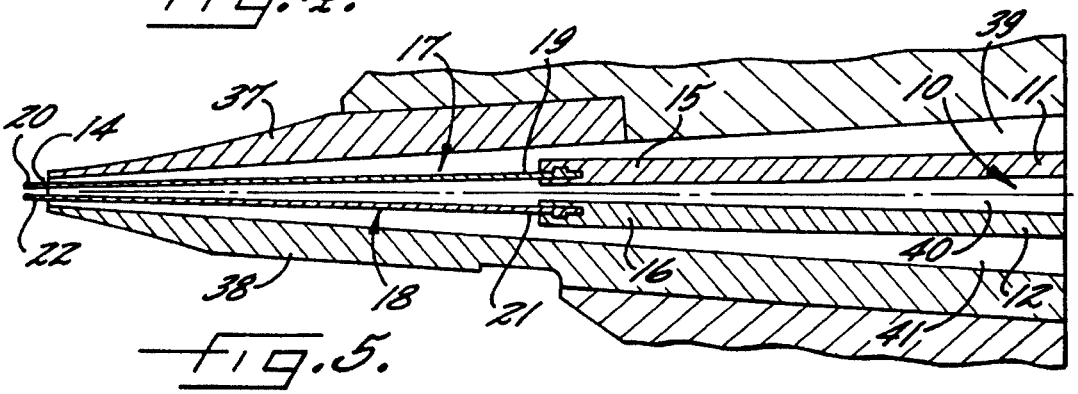
FIG. 5 is a cross sectional detailed view of the vane and vane extension as shown in FIG. 1.

In the illustrated embodiment, two rigid separator vanes 11 and 12 are provided in the slice chamber 10 to keep stock flow streams on each side of each of the vanes separated from each other. At the outlet from the tube bank distributor, through which the stock streams flow separated from one another, the slice chamber 10 has an upstream portion, not shown, which diverges in the direction of the stock flow, and on top of which the tube bank distributor is located when the headbox is mounted in an inverted position. Downstream thereof the slice chamber 10 has a downstream portion 13 converging in the direction of the stock flow and ending in a slice opening 14. Both of the vanes 11 and 12 have an upstream end, as shown in FIG. 5 and a square downstream end 15 and 16, respectively. Each of the vanes 11 and 12 has its upstream end securely fixed to the tube bank distributor in cantilever fashion and has its downstream end unattached and free, like what is disclosed in the above Canadian '142 patent, incorporated herein by reference, and both of the vanes 11 and 12 are sufficiently rigid to be capable of supporting unequal pressures and velocities in the stock flow streams.

Further, both of the vanes 11 and 12 are provided with a vane extension 17 and 18, respectively, having an upstream end 19 and 21 and a downstream end 20 and 22, respectively. The upstream end 19 and 21 of each vane extension is thinner than and exchangeably (i.e. replaceably) anchored to the square downstream end 15 and 16, respectively, of the separator vane to form an extended vane assembly. The vane assembly including vane 11 and vane extension 17 has a step 23 and 24, best shown in FIG. 2, on each side of the assembly. The other vane assembly including vane 12 and vane extension 18 has identical steps, but in order not to unnecessarily crowd FIG. 1, no reference numerals designating the steps are used in FIG. 1. However, any statement as to steps 23 and 24 apply also to the steps of the other vane assembly. The downstream end 20 and 22 of each of the vane extensions is unattached and free and located downstream of the slice opening 14.

In accordance with the present invention each of the vanes 11 and 12 and each of the vane extensions 17 and 18 has a portion located in the converging portion 13 of the slice chamber 10, and those portions of the vane extensions 17 and 18 and of the vanes 11 and 12 that are located in the converging portion 13 of the slice chamber 10 are of substantially equal length in the stock flow direction as shown in FIG. 5.

At the slice opening 14 the thickness of the vane extension 17 and 18 merely is a fraction of that of the vane 11 and 12, respectively, and the gap width of the slice opening 14 will be considerably smaller in a multilayer headbox of the present invention than in an air wedge multilayer headbox, where the vane or vanes extend out of the slice opening. The reduced gap width requires less space, and if the distances from the slice lips 37 and 38 to the forming fabrics 3 and 5 are maintained, the slice lips 37 and 38 can project farther into the converging throat 2 defined by the fabrics 3 and 5 just upstream of the forming zone, the first portion of which is designated 8. In a typical installation the free jet length 9 from the slice lips 37 and 38 to the first portion 8 of the forming zone can be reduced by more than half the length, e.g. to about 0.06 meters (about 2.4 in). This considerable reduction of the free length 9 of the jet considerably reduces the deterioration in cross sectional shape of the jet. In addition, thanks to the fact that those portions of the vane extension 17 and of the vane 11 that are located in the converging portion 13 of the slice chamber 10 are of substantially equal length in the stock flow direction, the steps 23 and 24 at the connection between vane 11 and its vane extension 17 will be located at an optimal location. Similarly, thanks to the fact that those portions of the vane extension 18 and of the vane 12 that are located in the converging portion 13 of the slice chamber 10 are of substantially equal length in the stock flow direction, the steps at the connection between vane 12 and its vane extension 18 will be located at an optimal location. These steps create an advantageous small scale turbulence in the stock flow streams to prevent flocculation of the papermaking fibers, and with the considerably reduced deterioration in the cross sectional shape of the jet, there are created conditions for the production of a multilayer paper web having an excellent layer formation.

Each vane extension 17 and 18 tapers from a thickness (shown at 27 in FIG. 3) on the order of 4 millimeters (about 0.16 in) at its upstream end 19 and 21, respectively, to a thickness (shown at 28 in FIG. 3) on the order of 1 millimeter (about 0.04 in) at its downstream end 20 and 22, respectively, and consists of a material having a modulus of elasticity of at least $20 \cdot 10^9$ newtons per square meter (about $2.9 \cdot 10^6$ psi). A thickness of 0.9 millimeters (about 0.035 in) at the downstream end of the vane extension has given excellent results. The vane extension material suitably is a fiber reinforced synthetic resin, preferably a glass fiber reinforced epoxy resin. The stiffer the vane extensions 17 and 18 are, the more pronounced the advantages resulting from the present invention appear to be. Carbon fibers could be used and are expected to give even better results than glass fibers but, as a rule, the extra advantage gained by substituting expensive carbon fibers for inexpensive glass fibers does not warrant the extra cost.

Also the vanes 11 and 12 suitably are made of glass fiber reinforced epoxy resin, or of stainless steel, and they preferably have a constant thickness (shown at 29 in FIG. 2) on the order of 0.01 meter, e.g. 12 millimeters (about ½ in). Such a thickness is sufficient for achieving the desired rigidity of the vane 11 or 12 to make the vane capable of supporting unequal pressures and velocities in the stock flow streams, so as to permit headbox operation in accordance with the paper forming method disclosed in the above United States '587 patent. Such a thickness also provides a suitable height of the steps 23 and 24 at the connection between vane 11 and vane extension 17, or the identical steps at the connection between vane 12 and vane extension 18.

In view of other parameters in the design of the headbox, the vane extensions 17 and 18 preferably have a length on the order of 0.3 meters (about 12 in) in the direction of the stock flow.

It is also preferred that each of the vane extensions 17 and 18 has its free end 20 and 22, respectively, located about 0.01 meter (about 0.4 in) downstream of the slice opening 14. Thereby, the projecting portion of the vane extension 17 and 18 is short enough not to obstruct an exchange of forming fabrics 3 and 5, nor does it risk being damaged at the exchange.

Figure 2:
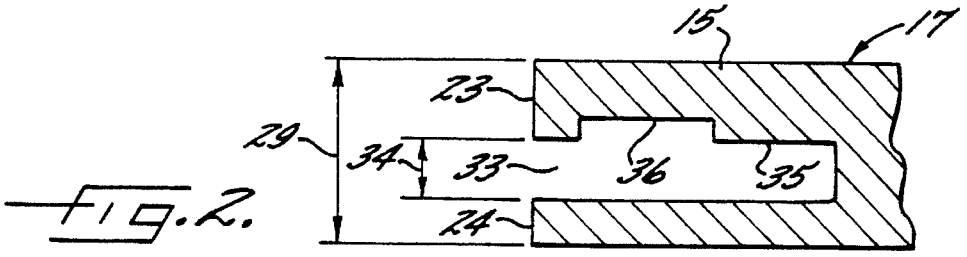
FIG. 2 is an enlarged scale cross sectional view of the downstream end of the upper one of the separator vanes shown in FIG. 1.
Figure 3:
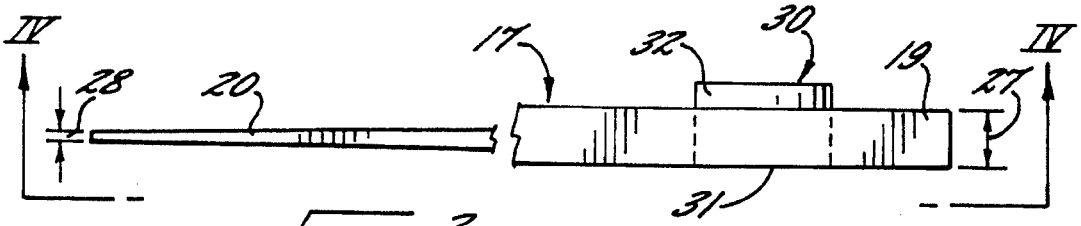
FIG. 3 is an enlarged scale elevational side view of the upper one of the vane extensions shown in FIG. 1.
Figure 4:
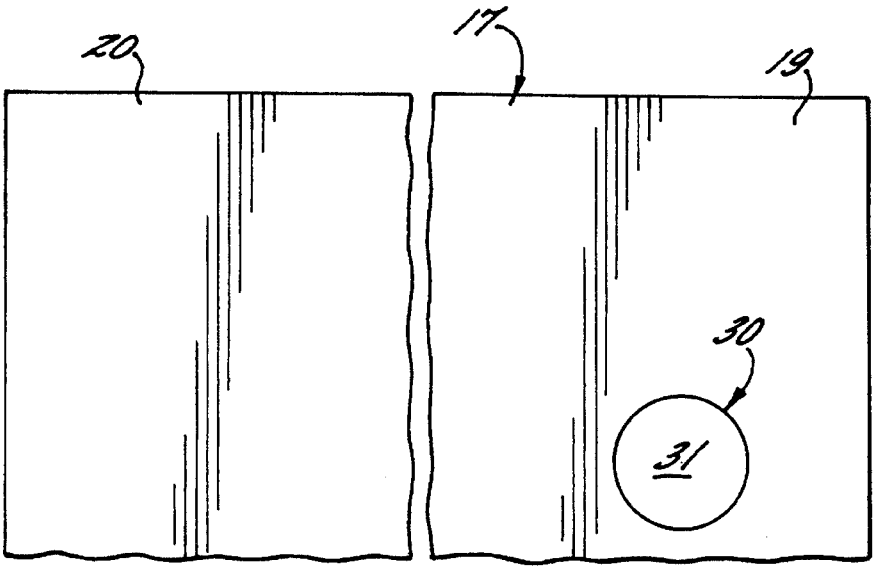
FIG. 4 is a bottom view of a portion of the vane extension taken on line IV—IV in FIG. 3.

FIGS. 2, 3, and 4 show how vane extension 17 is exchangeably anchored to vane 11. Since the anchoring of vane extension 18 to vane 12 is identical, it will not be described separately. As shown in FIGS. 3 and 4, vane extension 17 has a row of short equidistantly spaced dowels 30 of stainless steel located adjacent (i.e. located at, but spaced from) the upstream end 19 of the vane extension 17. The short dowels 30 are of a length that is smaller than a diameter of the dowel 30. All of the dowels 30 are mounted with an end face 31 flush with one face of the vane extension 17, and with a portion 32 projecting from the opposite face of the vane extension 17.

As shown in FIG. 2, a longitudinally extending groove 33 for receiving the upstream end 19 of the vane extension 17 including the dowels 30 is provided in an end face of the square downstream end 15 of the vane 11. This groove 33 has a gap width 34 on the order of 0.2 mm larger than the thickness of the vane extension 17 at the dowels 30. The groove 33 also has a sidewall 35 with a longitudinally extending recess 36 for accommodating the projecting portions 32 of the dowels 30, which keep the upstream end 19 of the vane extension 17 anchored in the groove 33. In case a vane extension has to be exchanged, it can be pulled out in the cross machine direction from the groove after one of the side walls of the headbox has been removed. Thereafter, a new vane extension with dowels is inserted in opposite direction into the groove and the removed headbox side wall is reinstalled.

FIGS. 1 and 2 also show that in a three-layer headbox, where there are two vanes 11 and 12 in the slice chamber 10 to form two outer stock flow channels 39 and 41 and an intermediary one 40, it is preferred that each of the grooves 33 is located closer to the intermediary stock flow channel 40 than to an adjacent one of the outer stock flow channels 39 and 41, so as to make step 23, located in said adjacent outer stock flow channel 39, twice as high as step 24, located in the intermediary stock flow channel 40, and so as to make the step located in the adjacent other outer stock flow channel 41 twice as high as the other step located in the intermediary stock flow channel 40. Thereby, the increase in channel area at the step will be of the same magnitude in all of the three stock flow channels 39, 40 and 41.

While the present invention above has been described with reference to the drawings, which show one preferred embodiment, several obvious modifications thereof are possible within the scope of the appended claims. As an illustrative example, it would be possible to apply the invention to a two-layer headbox having a single rigid vane provided with a considerably thinner tapering but rigid vane extension. Then, the steps formed where the vane extension is connected to the single vane should be of equal height to make the increase in channel area at the step be of the same magnitude in both of the stock flow channels. Of course, the invention could also be applied to a four-layer headbox, for example, having three rigid vanes with considerably thinner but rigid vane extensions. In this case, the relation between the heights of the steps are selected so as to provide channel area increases of the same magnitude in all of the four stock flow channels.

That which is claimed is:

1. A multilayer headbox comprising a slice chamber, a rigid separator vane mounted in the slice chamber for keeping stock flow streams on each side of the vane separated from each other, said slice chamber having a downstream portion converging in the direction of the stock flow and ending in a slice opening, said vane having an upstream end and a square downstream end, said vane being securely fixed in cantilever fashion at said upstream end and having its downstream end unattached and tree, said vane being sufficiently rigid to be capable of supporting unequal pressures and velocities in the stock flow streams, said headbox further having a rigid vane extension consisting of material having modulus of elasticity of at least $20 \cdot 10^9$ newtons per square meter and further having an upstream end and a downstream end, the upstream end of the vane extension being thinner than and anchored to the square downstream end of the separator vane to form an extended vane assembly having a step on each side of the assembly, the downstream end of the vane extension being unattached and free and located downstream of the slice opening, both of the vane and the vane extension having a portion located in the converging portion of the slice chamber, and said steps being located midway between an upstream start of the converging portion of the slice chamber and the slice opening at the downstream end of the converging portion.

2. A multilayer headbox as claimed in claim 1, wherein the vane extension tapers from a thickness on the order of 4 millimeters at its upstream end to a thickness on the order of 1 millimeter at its downstream end.

3. A multilayer headbox as claimed in claim 2, wherein the vane extension material is a fiber reinforced synthetic resin.

4. A multilayer headbox as claimed in claim 3, wherein the fiber reinforced synthetic resin is a glass fiber reinforced epoxy resin.

5. A multilayer headbox as claimed in claim 2, wherein the vane has a constant thickness on the order of 0.01 meter.

6. A multilayer headbox as claimed in claim 1, wherein the vane extension has a length on the order of 0.3 meters in the direction of the stock flow.

7. A multilayer headbox as claimed in claim 1, wherein the free end of the vane extension is located about 0.01 meter downstream of the slice opening.

8. A multilayer headbox comprising a slice chamber, a rigid separator vane mounted in the slice chamber for keeping stock flow streams on each side of the vane separated from each other, said slice chamber having a downstream portion converging in the direction of the stock flow and ending in a slice opening, said vane having an upstream end and a square downstream end, said vane being securely fixed in cantilever fashion at said upstream end and having its downstream end unattached and free, said vane being sufficiently rigid to be capable of supporting unequal pressures and velocities in the stock flow streams, said headbox further having a vane extension having an upstream end and a downstream end, the upstream end of the vane extension being thinner than and anchored to the square downstream end of the separator vane to form an extended vane assembly having a step on each side of the assembly, the downstream end of the vane extension being unattached and free and located downstream of the slice opening, both of the vane and the vane extension having a portion located in the converging portion of the slice chamber, and said steps being located midway between an upstream start of the converging portion of the slice chamber and the slice opening at the downstream end of the converging position, wherein the vane extension has a row of short equidistantly spaced dowels located adjacent the upstream end of the vane extension, said short dowels being of a length that is smaller than a diameter of the dowel, all of the dowels being mounted with an end face flush with one face of the vane extension, and with a portion projecting from an opposite face of the vane extension, and wherein a longitudinally extending groove for receiving the upstream end of the vane extension including the dowels is provided in an end face of the square downstream end of the vane, and said groove having a sidewall with a longitudinally extending recess for accommodating the projecting portions of the dowels.

9. A multilayer headbox as claimed in claim 8, wherein there are two vanes in the slice chamber to form a three-layer headbox having two outer stock flow channels and an intermediary one, and wherein each of the grooves is located closer to the intermediary stock flow channel than to an adjacent one of the outer stock flow channels, so as to make the step located in said adjacent outer stock flow channel twice as high as the step located in the intermediary stock flow channel.

* * * * *

UNITED STATES PATENT AND TRADEMARK OFFICE

CERTIFICATE OF CORRECTION

PATENT NO. : 5,545,294

DATED : August 13, 1996

INVENTOR(S) : Lindén, et al.

It is certified that error appears in the above-identified patent and that said Letters Patent is hereby corrected as shown below:

Title page,

In the REFERENCES CITED [56]:

The inventors recited for U.S. Patent No. 4,617,091 should be --Rodal et al.-- and not "Rodel et al.".

Column 5, line 30, after "FIG. 5" insert --,--;

Column 8, line 10, "tree" should be --free--; and

Column 8, line 14, after "having" insert --a--.

Signed and Sealed this

Nineteenth Day of November, 1996

*Attest:*

Bruce Lehman

BRUCE LEHMAN

*Attesting Officer*

*Commissioner of Patents and Trademarks*